US006527061B2

(12) United States Patent
Liao

(10) Patent No.: US 6,527,061 B2
(45) Date of Patent: Mar. 4, 2003

(54) DRIVING MECHANISM FOR PNEUMATIC TOOLS

(76) Inventor: Hale Liao, No. 1, Alley 16, Lane 40, Jinn Te Road, Taichung (TW)

( * ) Notice: Subject to any disclaimer, the term of this patent is extended or adjusted under 35 U.S.C. 154(b) by 1 day.

(21) Appl. No.: 09/922,610

(22) Filed: Aug. 6, 2001

(65) Prior Publication Data

US 2003/0024714 A1 Feb. 6, 2003

(51) Int. Cl.[7] ..... B25D 15/00
(52) U.S. Cl. ..... 173/93.5; 173/93
(58) Field of Search ..... 173/93, 93.5, 93.6, 173/93.7, 109

(56) References Cited

U.S. PATENT DOCUMENTS 3,321,043 A * 5/1967 Vaughn ..... 173/93.5
3,533,479 A * 10/1970 Madsen et al. ..... 173/93.5
5,435,398 A * 7/1995 Juan ..... 173/93
5,645,130 A * 7/1997 Schoeps ..... 173/93
5,887,666 A * 3/1999 Chen et al. ..... 173/93
5,906,244 A * 5/1999 Thompson et al. ..... 173/93.5
6,024,180 A * 2/2000 Lin ..... 173/93.5

* cited by examiner

*Primary Examiner*—Scott A. Smith

(57) ABSTRACT

A driving mechanism for pneumatic tools includes a casing in which a rotor is received. The rotor has a passage defined therethrough for receiving a shaft therein. A ridge extends from an outer periphery of the rotor and is engaged with a groove defined in an inner periphery of the casing. A surface is defined in an outer periphery of the rotor and engaged with two support surfaces extending from the inner periphery of the casing. Two driving surfaces are defined in an inner periphery of the rotor. The shaft has a protrusion extending from an outer periphery of the shaft and is driven by one of the driving surfaces of the rotor. The rotor is shifted on the two support surfaces to disengage the driving surface from the protrusion when the object is tightened.

2 Claims, 17 Drawing Sheets

DRIVING MECHANISM FOR PNEUMATIC TOOLS

FIELD OF THE INVENTION

The present invention relates to a driving mechanism for pneumatic tools and rotor rotatably contacts the inside of the casing at two surfaces and one point so that the rotor can be operated by large torque.

BACKGROUND OF THE INVENTION

A conventional driving mechanism for pneumatic tools is shown in FIGS. 1 to 3 and generally includes a casing 10 having a front hole 12 in a front surface of the casing 10 and a rear hole 13 in a rear surface of the casing 10. A rotor 20 is rotatably received in the casing 10 and has two grooves 23 and 24 respectively defined in two opposite outside of the rotor 20. A hole 21 is defined in the rotor 20 and two driving surfaces 22 extend inward from an inside of the hole 21. Two rods 18 extend through the front surface of the casing 10 and are respectively engaged with the two grooves 23, 24 so as to connect the rotor 20 to the casing 10. A shaft 30 extends through the front hole 12 of the casing 10 and the hole 21 in the rotor 20. A front end of the shaft 30 has an engaging member 34 to be connected with a socket (not shown) and a rear end 32 of the shaft 30 is engaged with the rear hole 13. The casing 10 further has a toothed driving part 14 so as to be connected to a driving source. A block 33 extends from the shaft 30 and is located in the hole 21 of the rotor 20. A flange 31 is engaged with the inside of front surface so that the shaft 30 will not drop from the front hole 12. Referring to FIGS. 4 and 5, when the casing 10 is rotated, the rotor 20 is rotated together with the casing 10 and the block 33 will be pushed by the driving surface 22 so as to output a torque.

Referring to FIG. 6, when the object to be tightened is locked, the shaft 30 cannot be rotated any further, the rotor 20 is forced to roll on one of the rods 18 a small angle to disengage the driving surface 22 from the block 33. The rotor 20 keeps on rotating and the point "A" contacts the block 33 and pushes the rotor 20 to roll on the rod 18 to its operation position again. Therefore, the driving surface 22 can impact the block 33 again. If the user feels two or three times of the shifting of the rotor 20, he/she knows that the object is totally tightened.

FIG. 9 shows that two rotors 20 are installed in the casing 10 and the shaft 30 has two blocks 33 so that the shaft 30 can be operated in balance.

The torque output is decided by the engagement between the two rods 18 and the two grooves 23, 24. The rods 18 could be worn out to affect the torque and the block 33 is driven by only one driving surface 22 may cause shaking.

SUMMARY OF THE INVENTION

In accordance with one aspect of the present invention, there is provided a driving mechanism for pneumatic tools and the mechanism comprises a casing having a groove defined in an inner periphery of the casing and two support surfaces extend from the inner periphery of the casing. A rotor is received in the casing and has a passage defined therethrough. A ridge extends from an outer periphery of the rotor and is engaged with the groove of the casing. A surface is defined in an outer periphery of the rotor and engaged with the two support surface. Two driving surfaces are defined in an inner periphery of the rotor. A shaft extends through the passage of the rotor and has a protrusion extending from an outer periphery of the shaft. The protrusion is driven by one of the two driving surfaces.

The primary object of the present invention is to provide a driving mechanism for a pneumatic tool wherein the shaft is driven by two driving surfaces.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
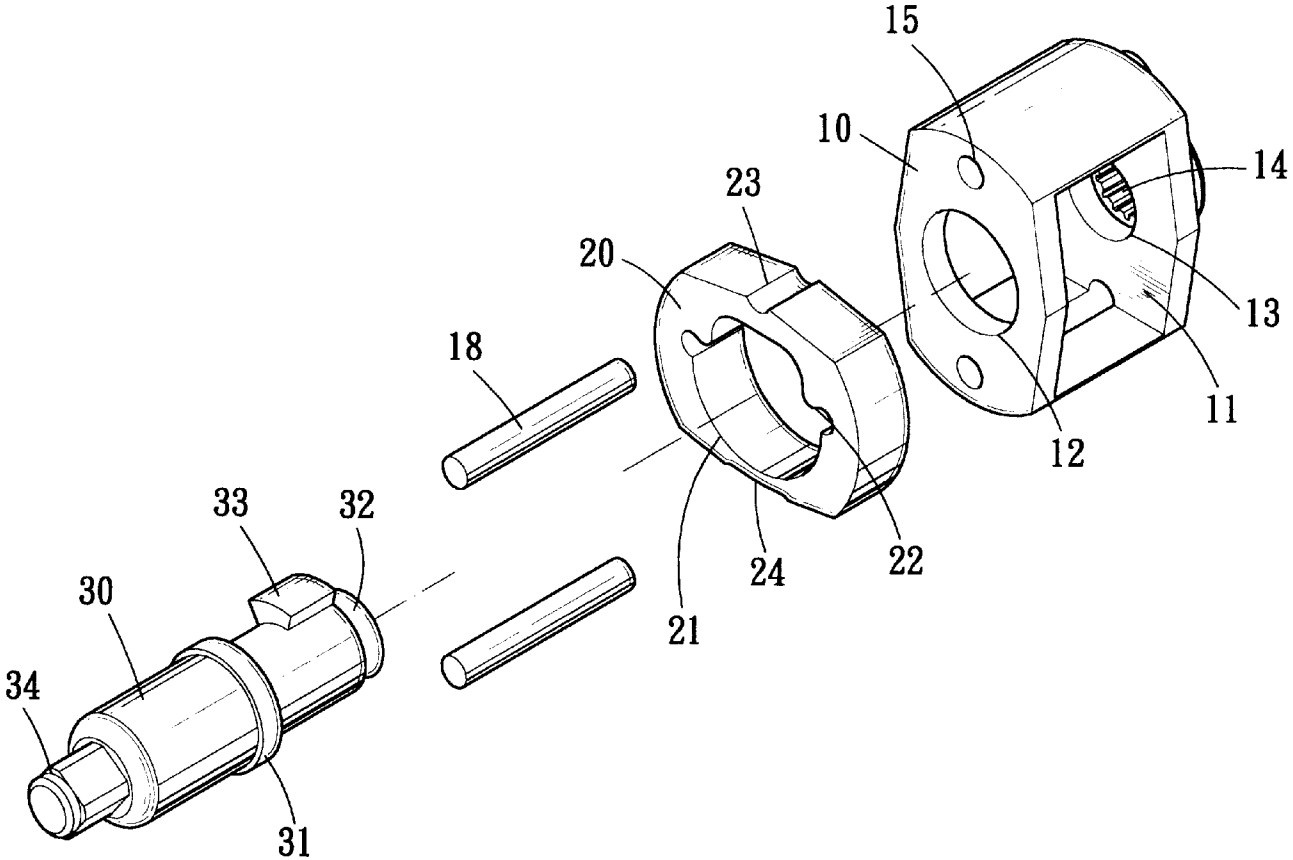
FIG. 1 PRIOR ART
FIG. 1 is an exploded view to show a conventional driving mechanism for pneumatic tools.
Figure 2:
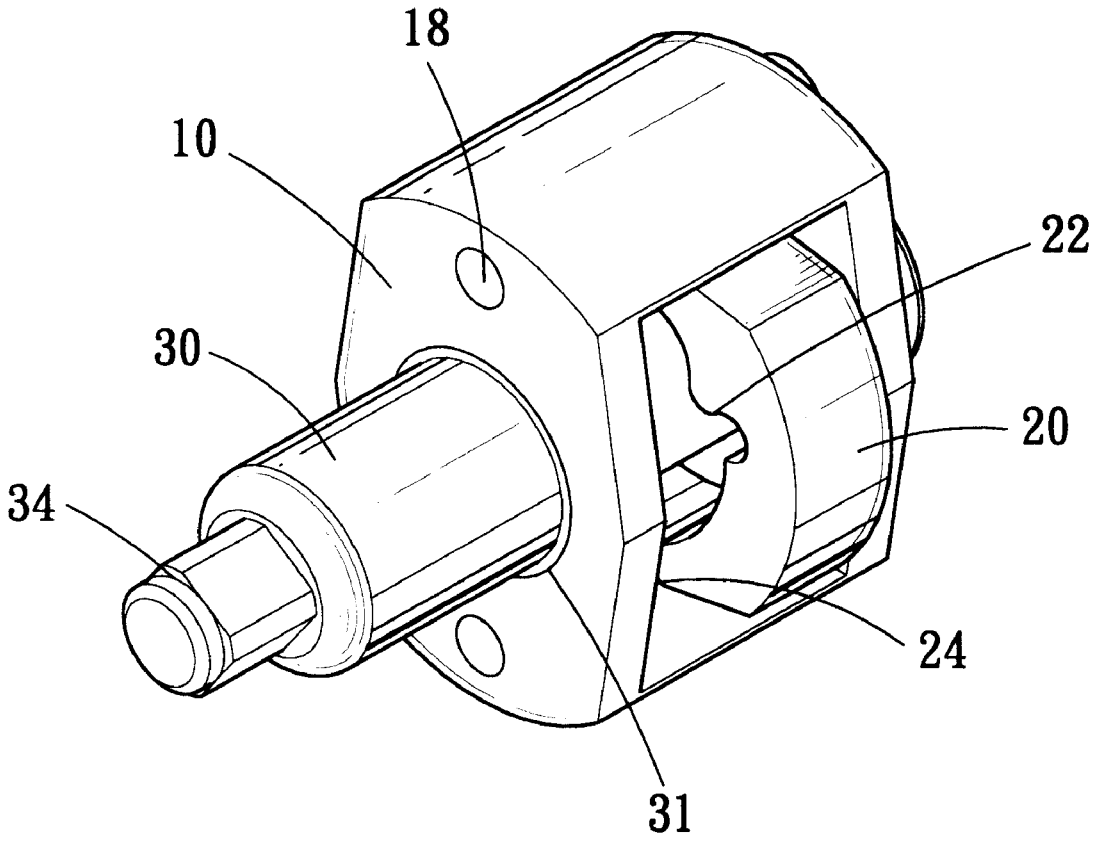
F I G. 2 PRIOR ART
FIG. 2 is a perspective view to show the conventional driving mechanism for pneumatic tools.
Figure 3:
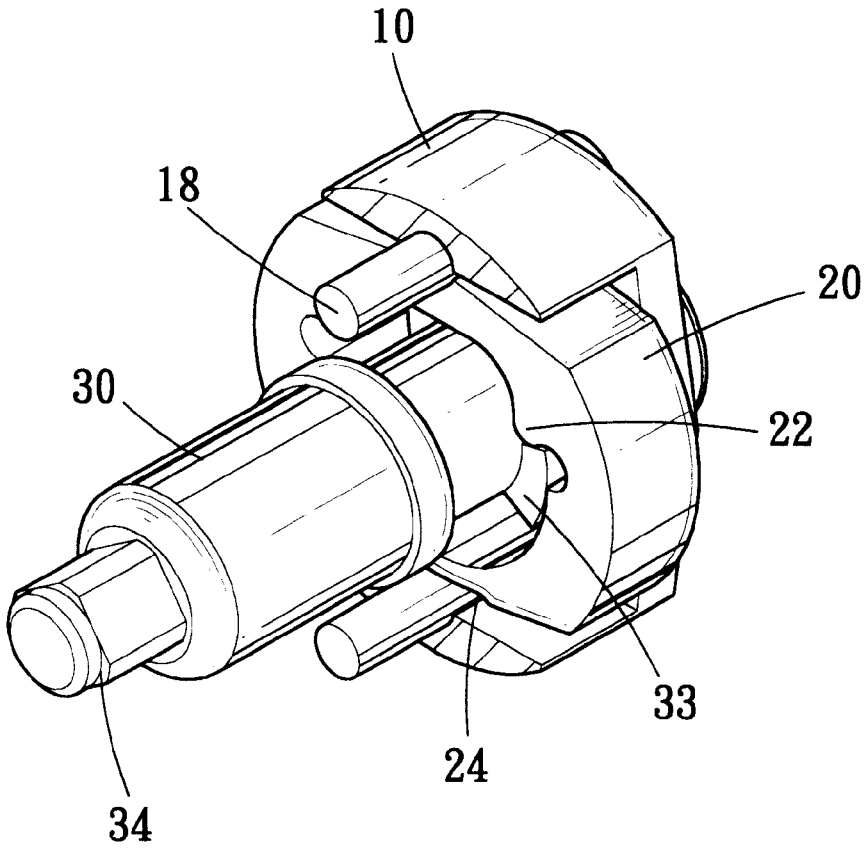
F I G. 3 PRIOR ART
FIG. 3 is a perspective view to show the conventional driving mechanism for pneumatic tools, wherein part of the casing is removed for illustrative purposes.
Figure 4:
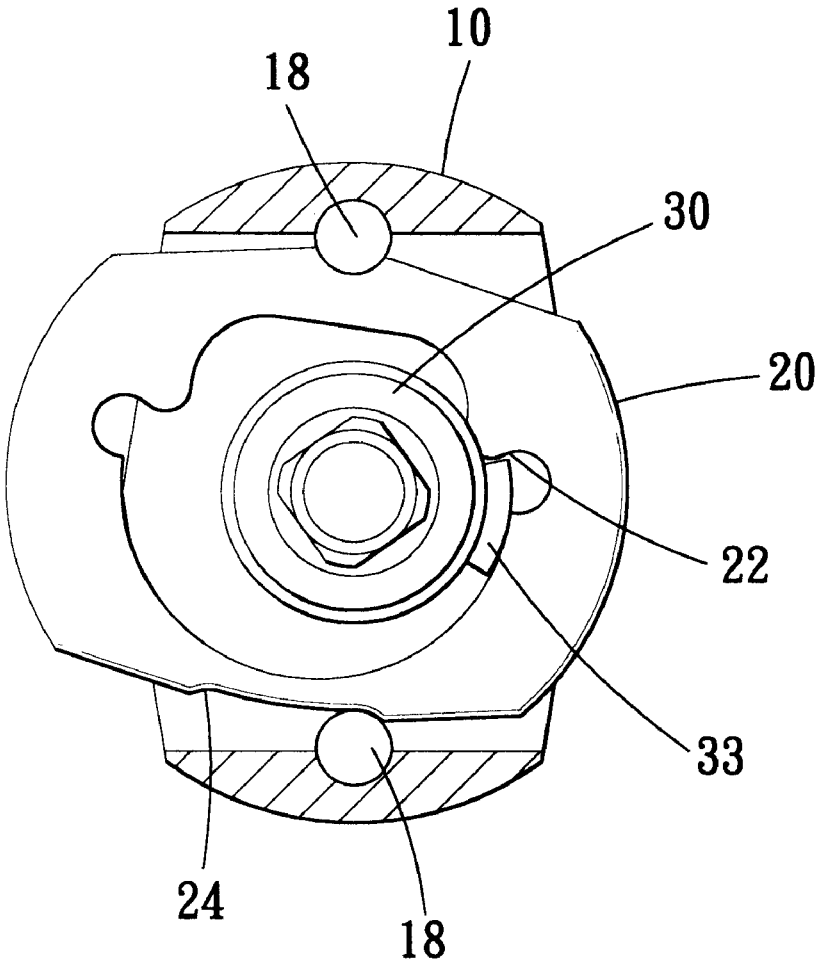
F I G. 4 PRIOR ART
FIG. 4 is an end view to show the conventional driving mechanism for pneumatic tools.
Figure 5:
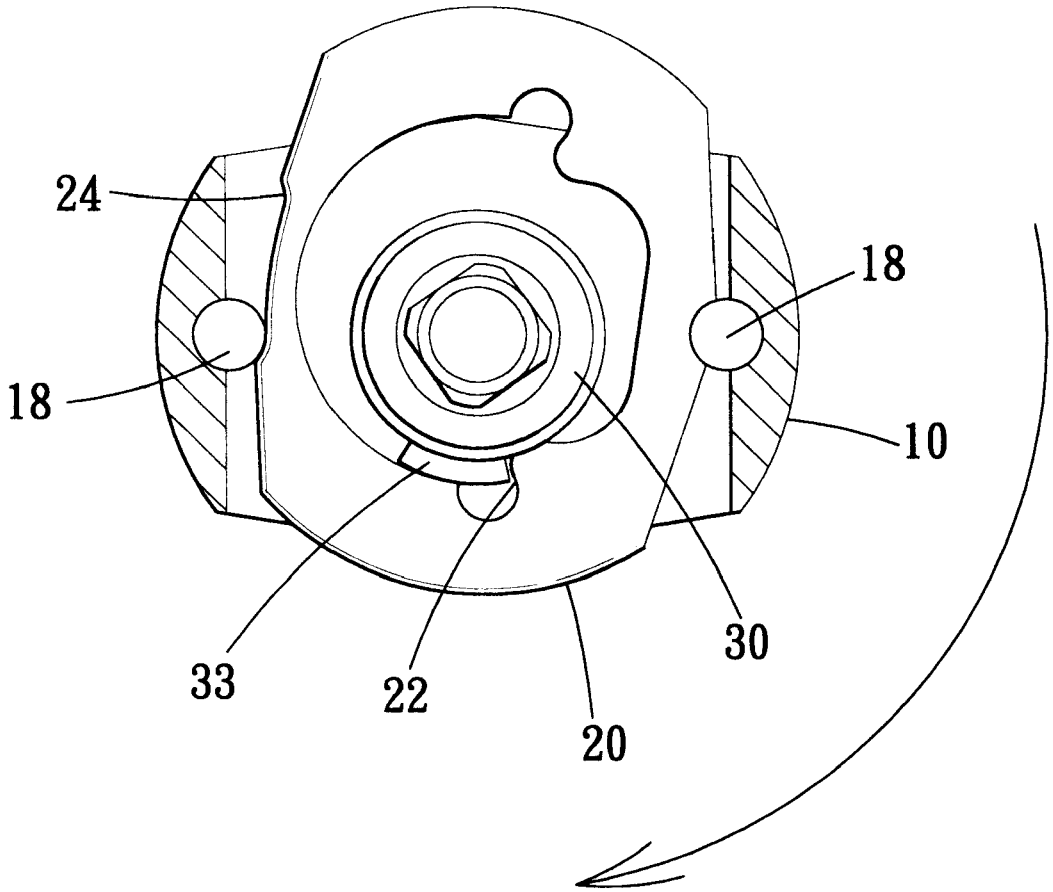
F I G. 5 PRIOR ART
FIG. 5 is an end view to show the block is driven by the driving surface of the rotor of the conventional driving mechanism for pneumatic tools.
Figure 6:
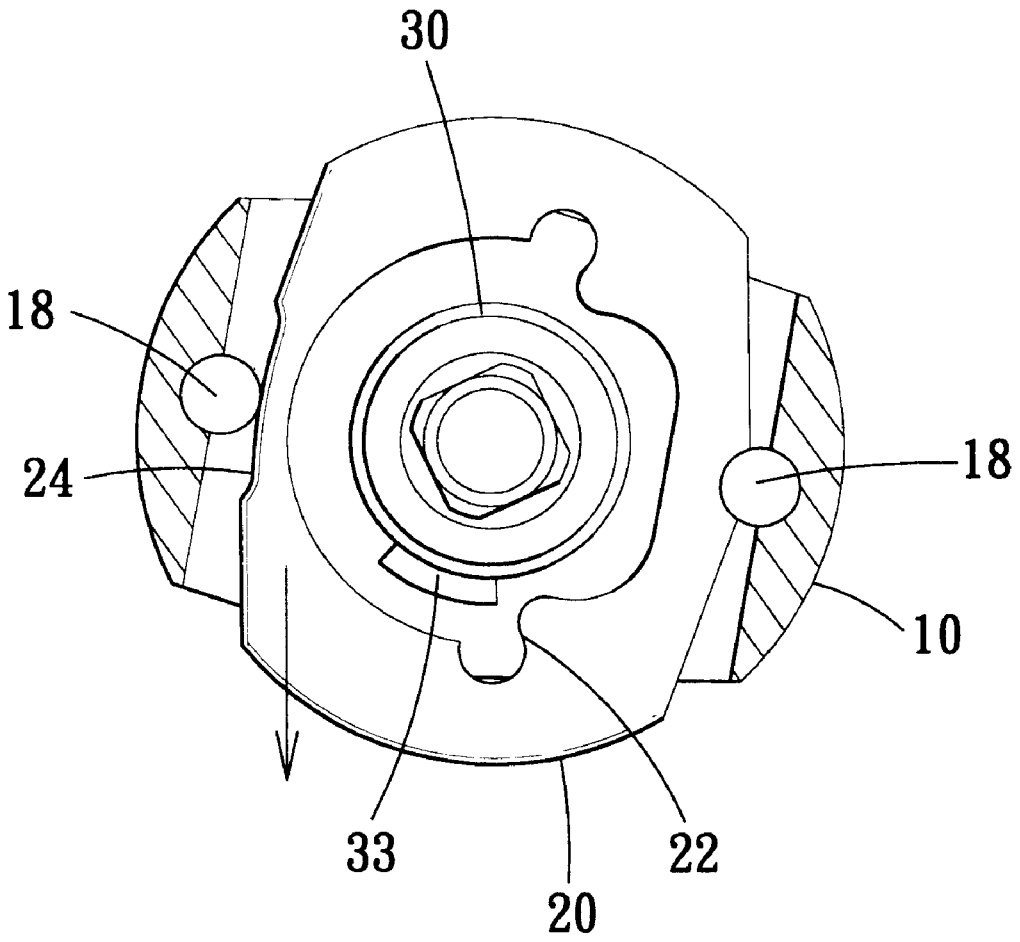
F I G. 6 PRIOR ART
FIG. 6 is an end view to show the rotor is shifted when the object to be tightened by the conventional driving mechanism is tightened.
Figure 7:
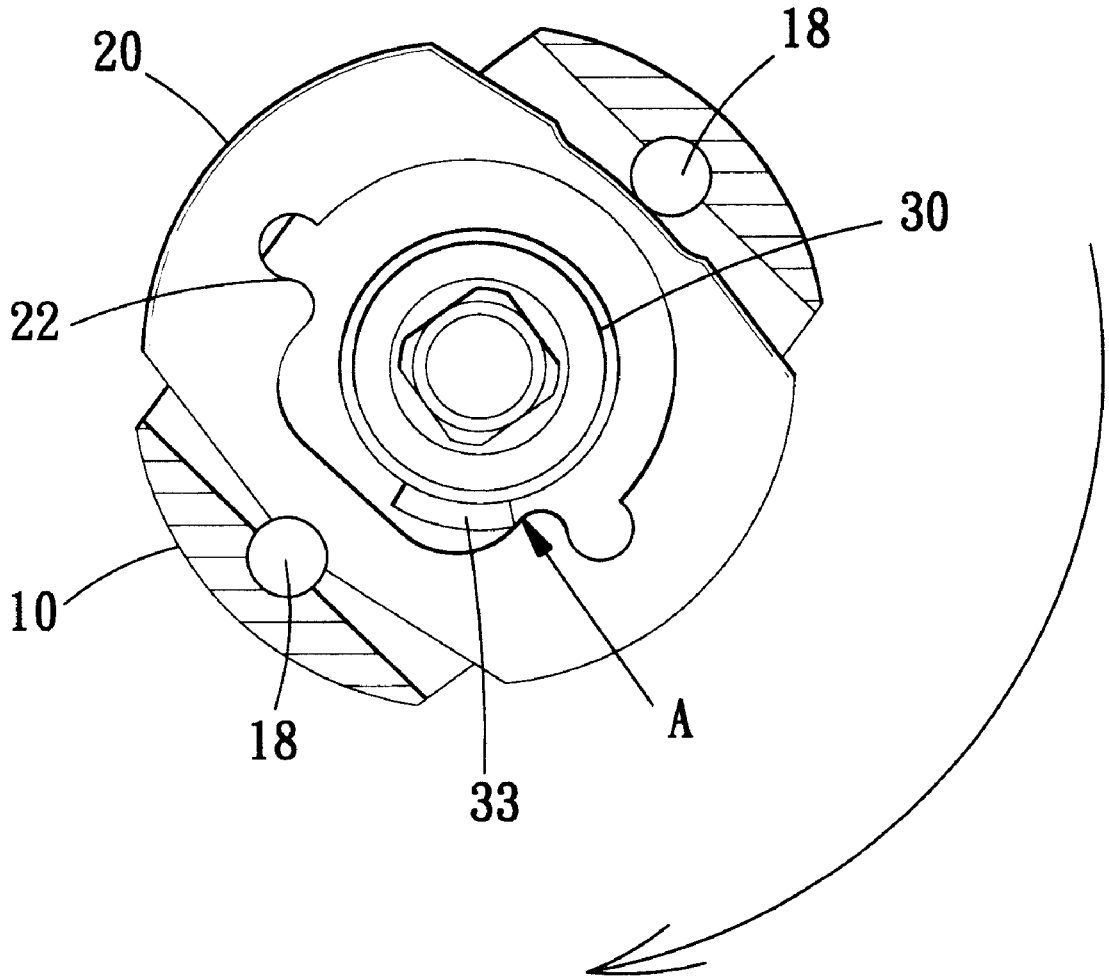
F I G. 7 PRIOR ART
FIG. 7 is an end view to show the block is pushed by a point "A" in the rotor to shift the rotor of the conventional driving mechanism for pneumatic tools.
Figure 8:
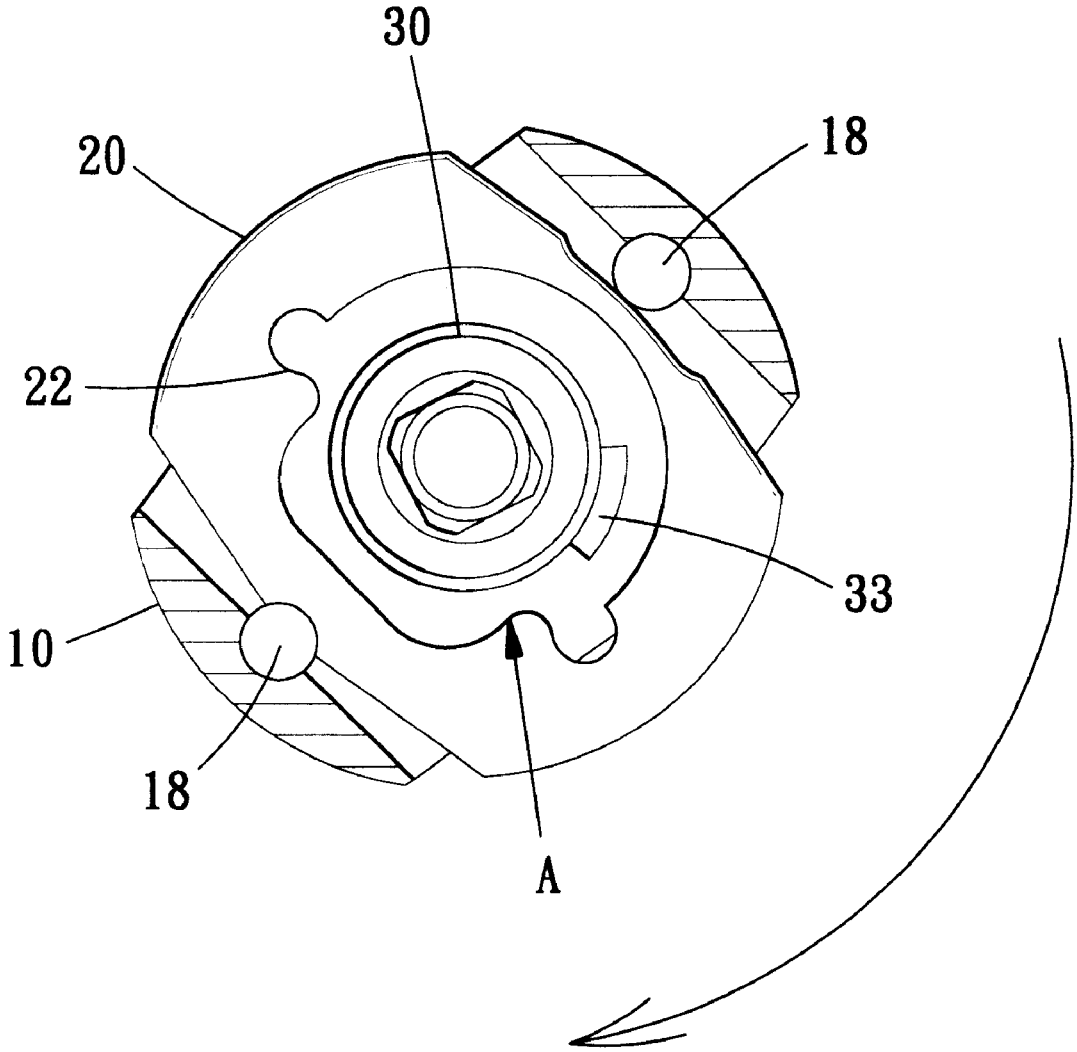
F I G. 8 PRIOR ART
FIG. 8 is an end view to show that the rotor is shifted to its original position by the impact between the point "A" and the block of the conventional driving mechanism for pneumatic tools.
Figure 9:
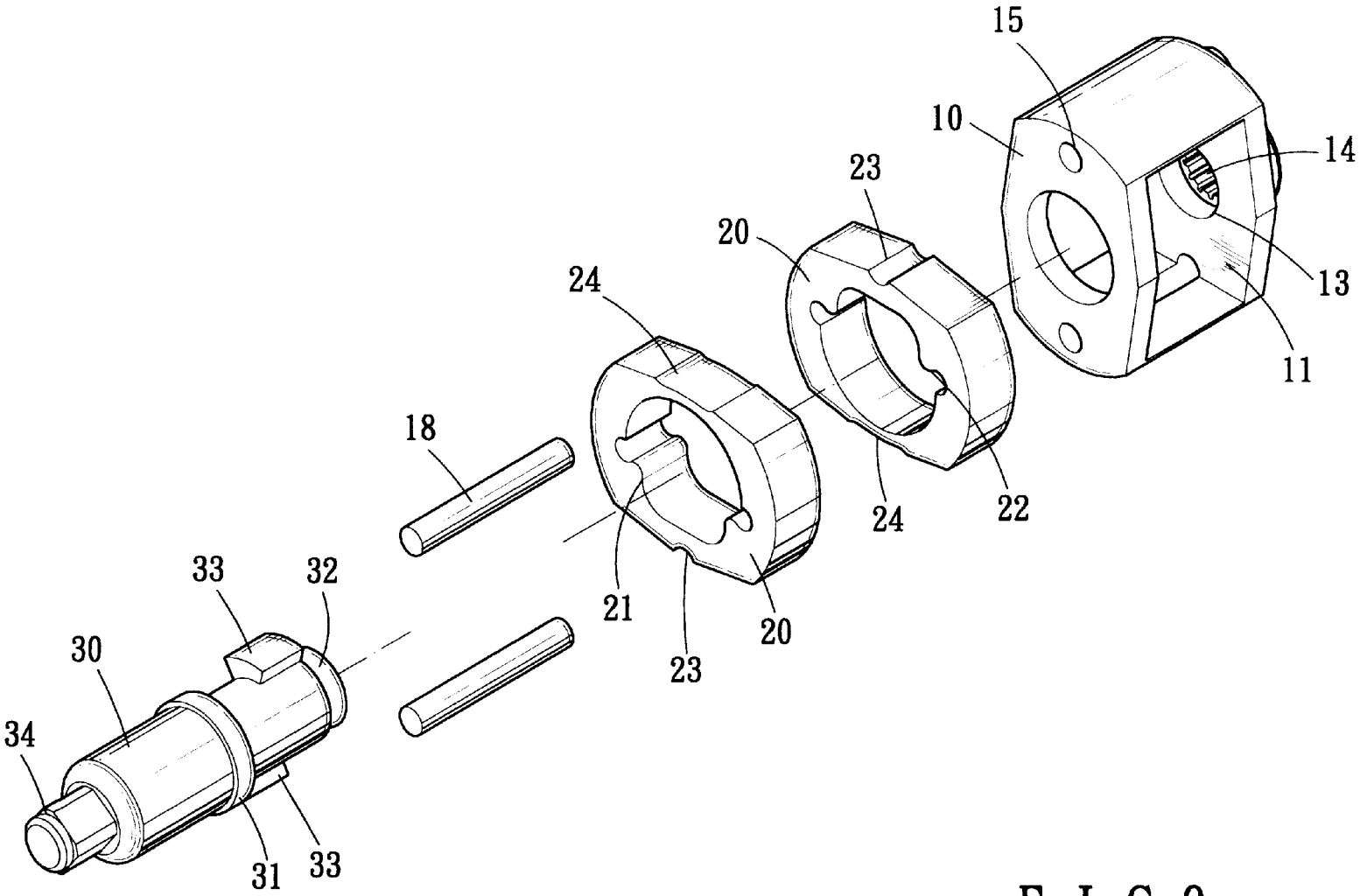
FIG. 9 PRIOR ART
FIG. 9 is an exploded view to show two rotors are used in the conventional driving mechanism for pneumatic tools.
Figure 10:
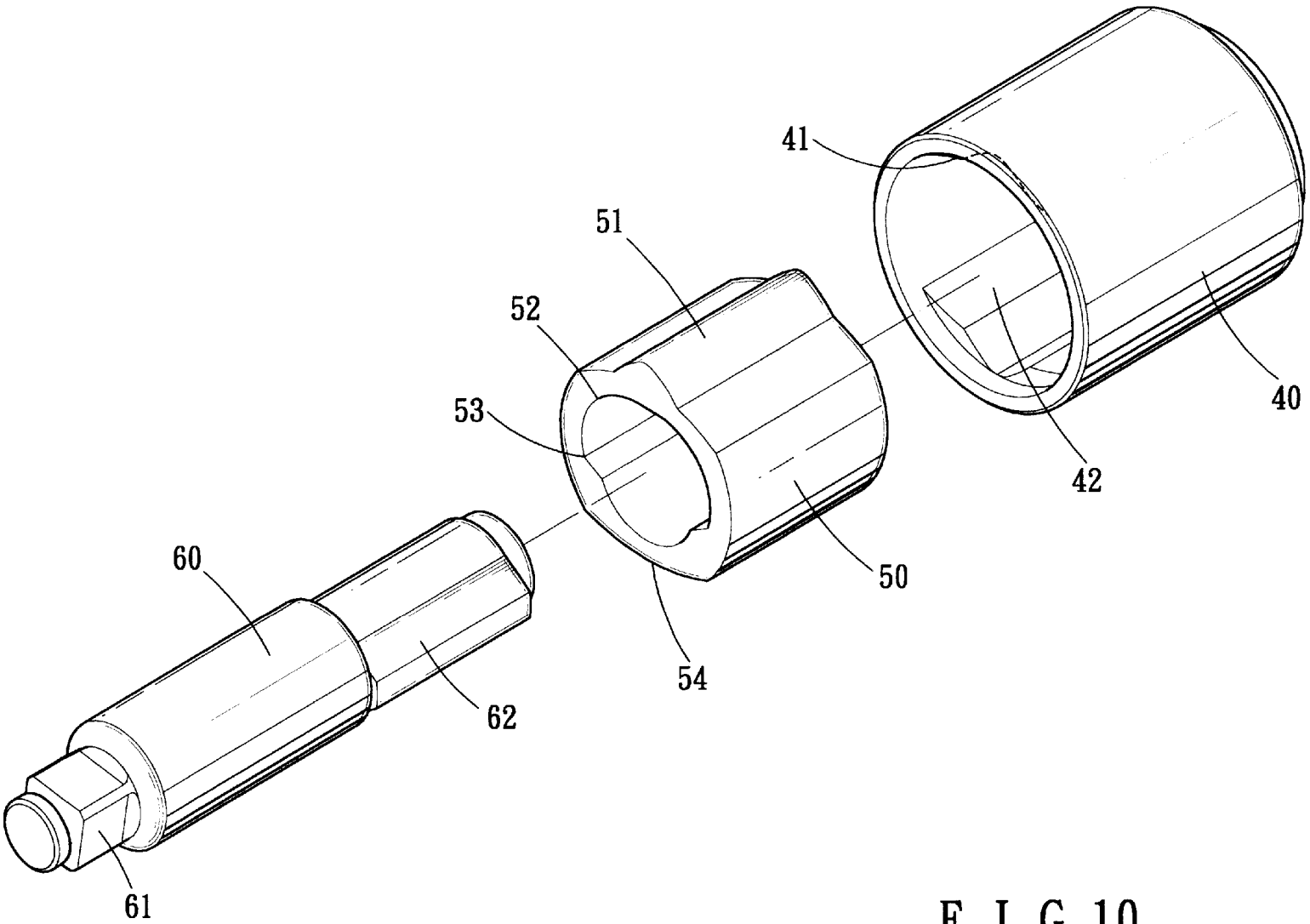
FIG. 10 is an exploded view to show a driving mechanism for pneumatic tools of the present invention.
Figure 11:
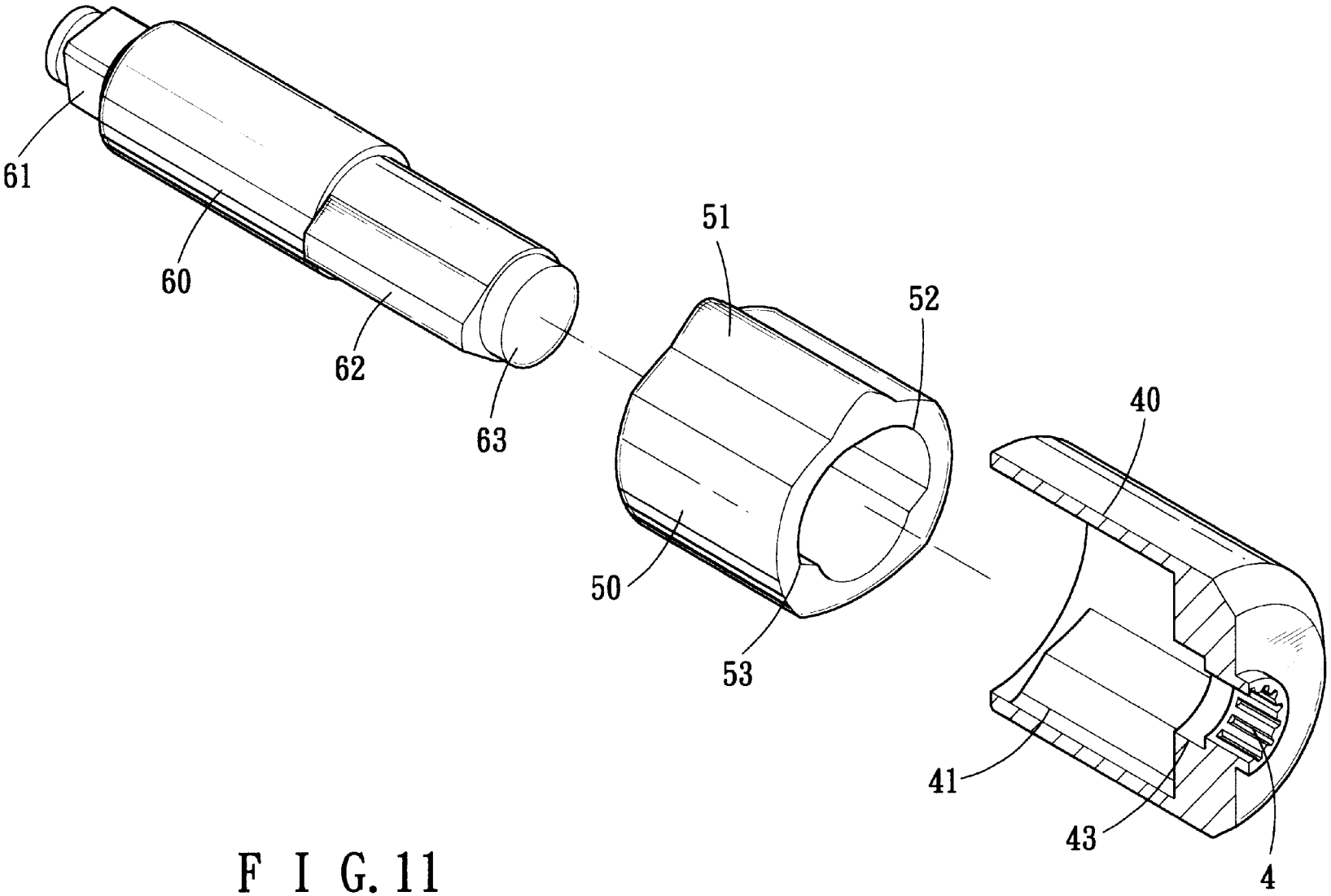
FIG. 11 is an exploded view to show the driving mechanism for pneumatic tools of the present invention wherein part of the casing is removed for illustrative purposes.
Figure 12:
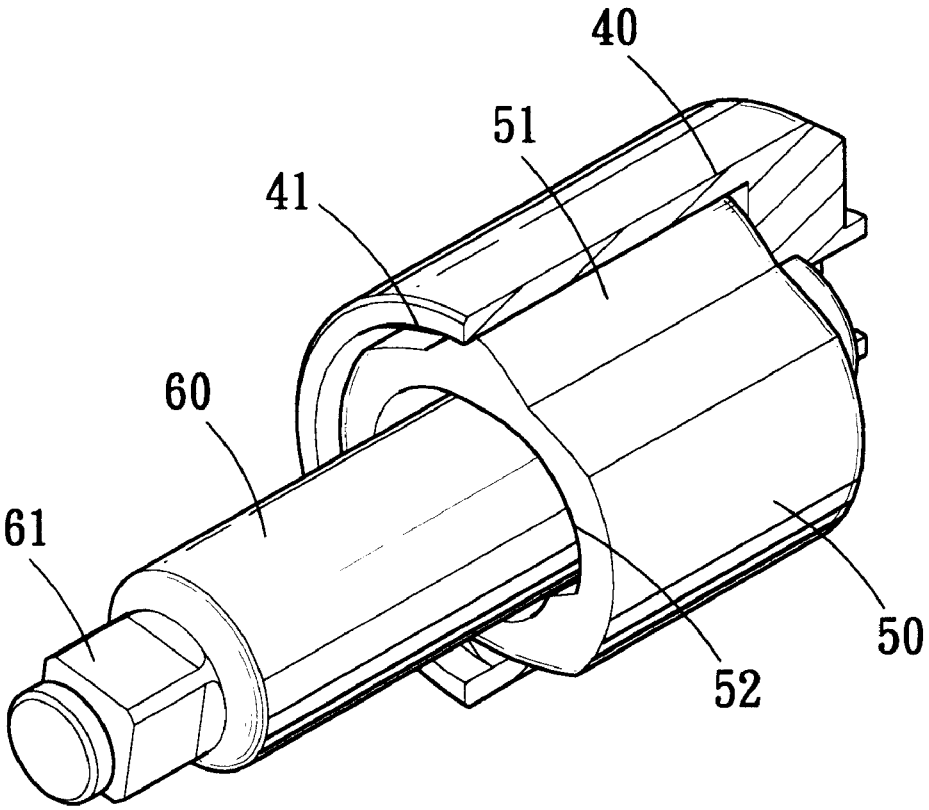
FIG. 12 is a perspective view to show the driving mechanism for pneumatic tools of the present invention wherein part of the casing is removed for illustrative purposes.
Figure 13:
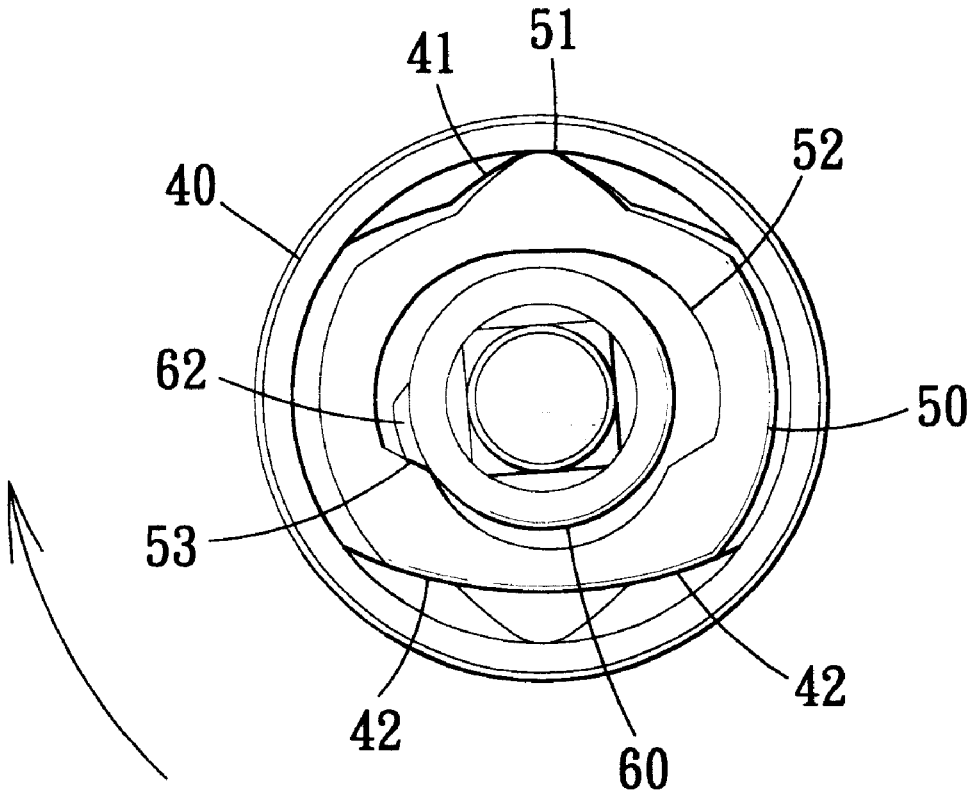
FIG. 13 is an end view to show the driving mechanism for pneumatic tools of the present invention.

Referring to FIGS. 10 to 13, the driving mechanism for pneumatic tools of the present invention comprises a tubular casing 40 having a groove 41 defined in an inner periphery of the casing 40 and two support surfaces 42 extend from the inner periphery of the casing 40. A rotor 50 movably received in the casing 40 and has a passage 52 defined therethrough. A ridge 51 extends from an outer periphery of the rotor 50 and is engaged with the groove 41 of the casing 40. A surface 54 is defined in an outer periphery of the rotor 50 and engaged with the two support surface 42 of the casing 10. Two driving surfaces 53 are defined in an inner periphery of the rotor 50.

A shaft 60 extends through the passage 52 of the rotor 50 and has a protrusion 62 extending from an outer periphery of the shaft 60. The protrusion 62 can be driven by one of the two driving surfaces 53. A first end of the shaft 60 has an engaging member 61 so as to be connected to a socket (not shown), and a second end of the shaft 63 is engaged with a hole 43 in the casing 40. A tube with a toothed inner periphery 4 extends from the casing 40 so as to be connected to a driving source to rotate the casing 40. When the casing 40 is rotated, the rotor 50 is rotated with the casing 40 because the rotor 50 is driven by the two support surfaces 42. The protrusion 62 is driven by one of the driving surfaces 53 so that a torque is output from the engaging member 61.

Figure 14:
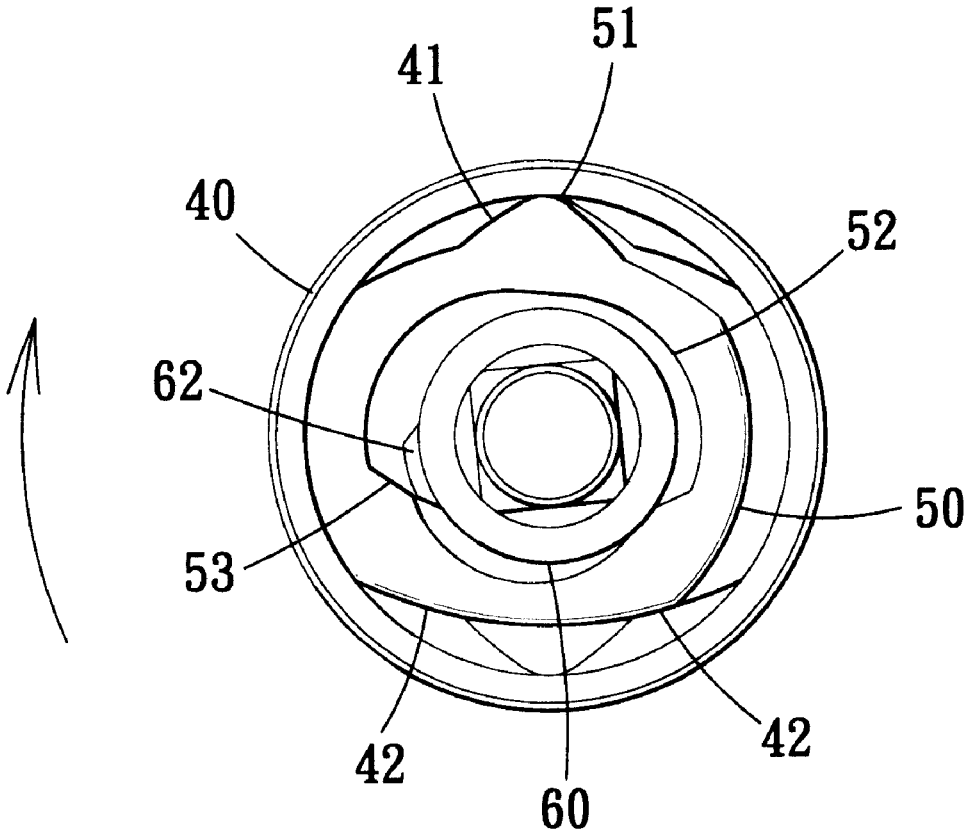
FIG. 14 is an end view to show that the rotor of the present invention is shifted to disengage the driving surface from the protrusion.

Referring to FIG. 14, when the object to be tightened is locked tight, the shaft 60 cannot be rotated, the rotation of the rotor 50 is shifted on the two support surfaces 42 to disengage the driving surface 53 from the protrusion 62 so that the rotor 50 is rotated without driving the shaft 60.

Figure 15:
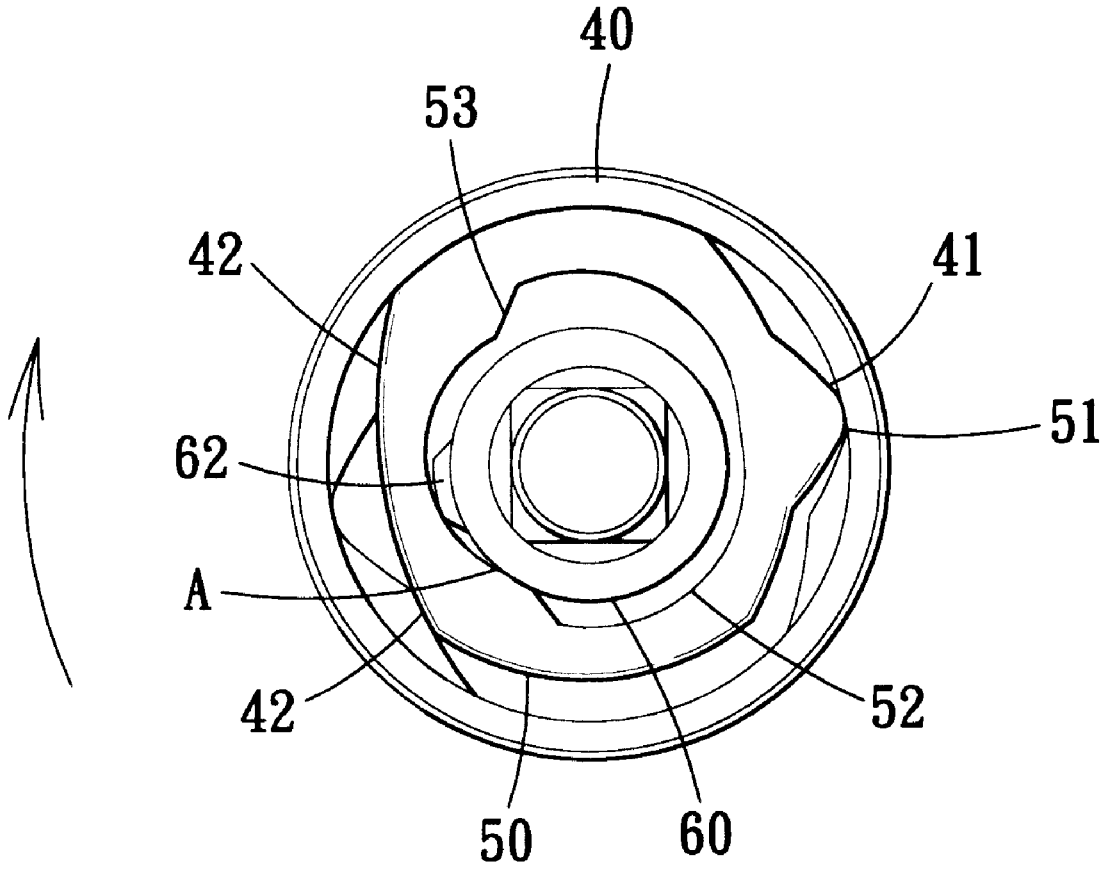
FIG. 15 is an end view to show that the rotor keeps on rotating and a point "D" contacts the protrusion.
Figure 16:
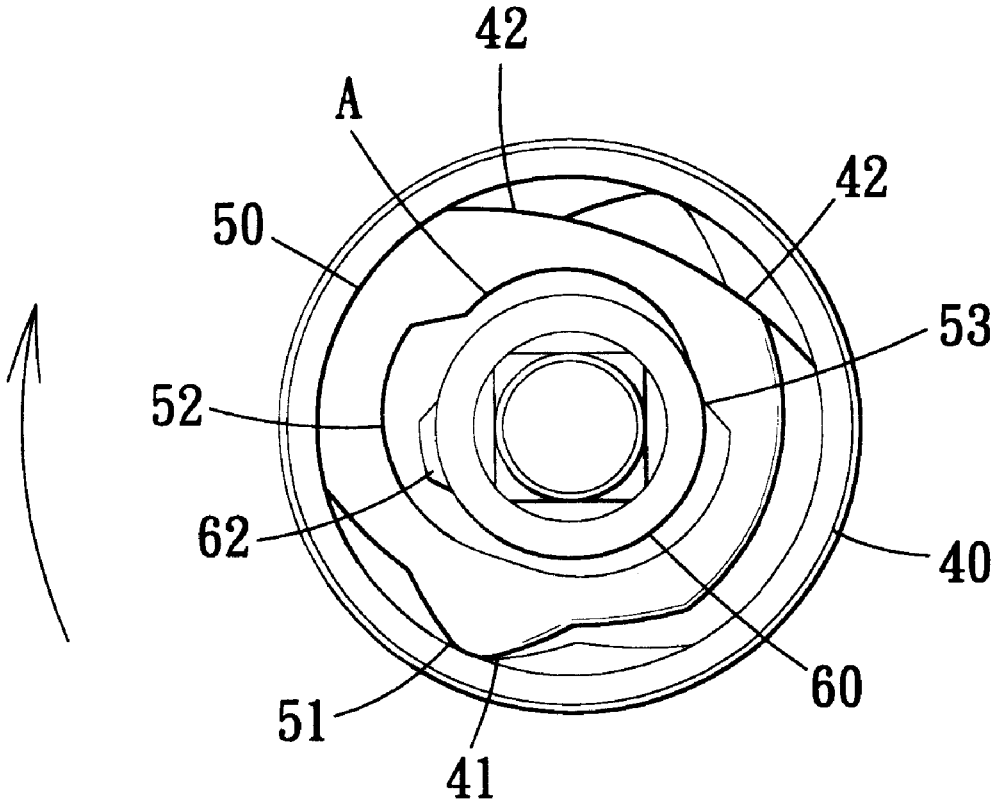
FIG. 16 is an end view to show that the point "D" moves over the protrusion.

Referring to FIG. 15, as the rotor 50 keeps on rotating and a point "A" on the rotor 50 contacts the protrusion 62, the protrusion 62 pushes the rotor 50 to its original position so that the protrusion 62 can be driven again by the driving surface 53 as shown in FIG. 16. The rotor 50 is shifted on the support surfaces 42 which provide the rotor 50 a sufficient support so that a large torque can be output.

Figure 17:
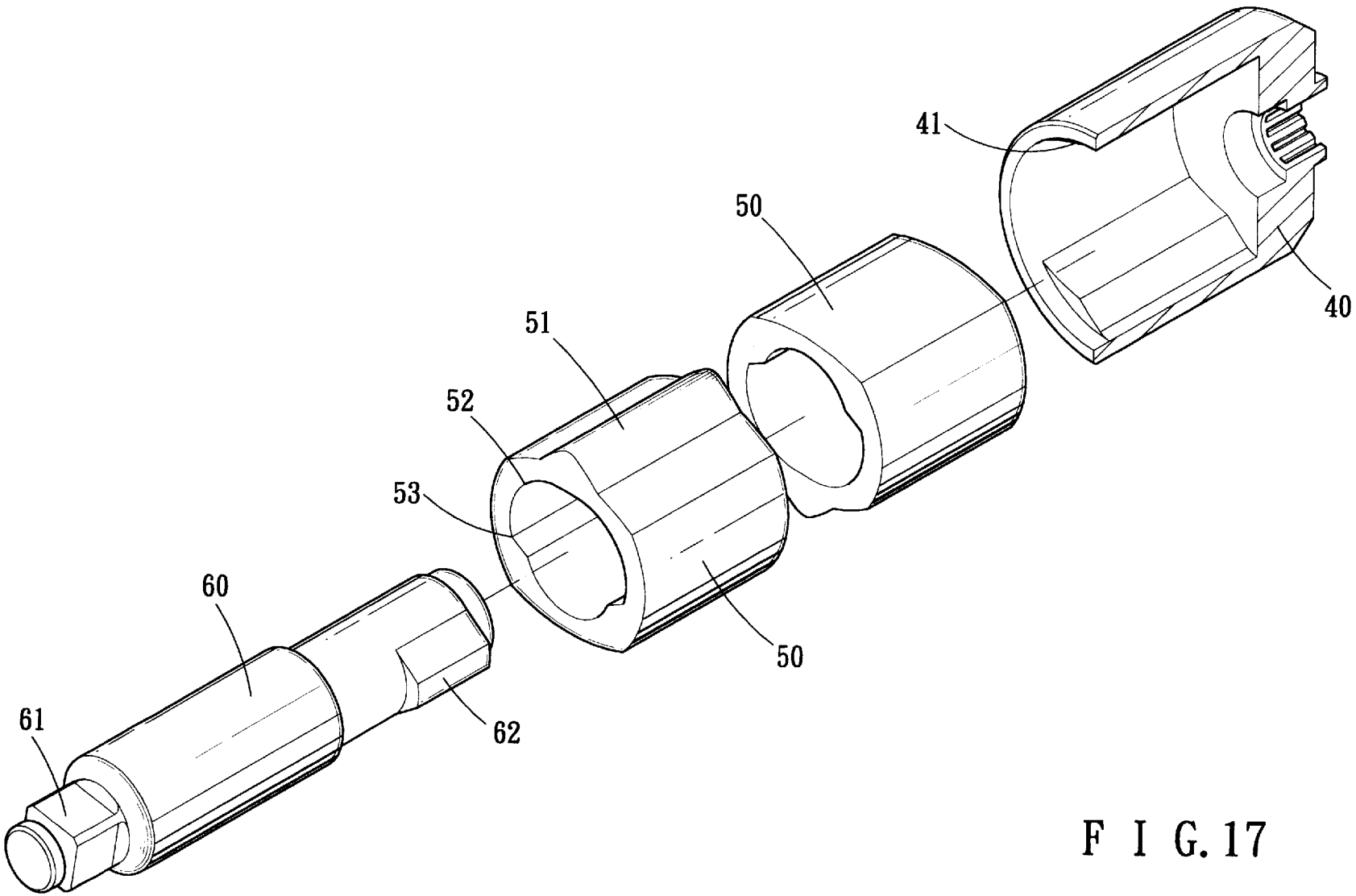
FIG. 17 is an exploded view to show two rotors are installed in the casing of the driving mechanism for pneumatic tools of the present invention.

As shown in FIG. 17, the driving mechanism can also employ two rotors 50 received in the casing 40 and the two respective driving surfaces 53 of the two rotors 50 are arranged in different directions so that the pneumatic tool can be operated in a balance condition.

While we have shown and described the embodiment in accordance with the present invention, it should be clear to those skilled in the art that further embodiments may be made without departing from the scope of the present invention.

What is claimed is:

1. A driving mechanism for pneumatic tools, comprising:

a casing having a groove defined in an inner periphery of said casing, two support surfaces extending from said inner periphery of said casing;

a rotor received in said casing and having a passage defined therethrough, a ridge extending from an outer periphery of said rotor and engaged with said groove of said casing, a surface defined in an outer periphery of said rotor and engaged with said two support surface, two driving surfaces defined in an inner periphery of said rotor, and a shaft extending through said passage of said rotor and having a protrusion extending from an outer periphery of said shaft.

2. The driving mechanism as claimed in claim 1, wherein said rotor is movable on said two support surfaces of said casing.

* * * * *